United States Patent [19]

Zeitlin et al.

[11] Patent Number: 4,706,490

[45] Date of Patent: Nov. 17, 1987

[54] FORGING PRESS WITH YOKE DESIGN FOR ATTACHING TIE-RODS TO CROSSHEADS

[75] Inventors: Alexander Zeitlin, White Plains; Jack Brayman, Staten Island; Adam Zandel, Forest Hills, all of N.Y.

[73] Assignee: Press Technology Corp., White Plains, N.Y.

[21] Appl. No.: 821,790

[22] Filed: Jan. 23, 1986

[51] Int. Cl.[4] ..... B21J 13/04

[52] U.S. Cl. ..... 72/455; 100/214

[58] Field of Search ..... 72/455, 456, 453.09; 100/214, 228, 269 R, 295, 918; 52/227; 248/676

[56] References Cited

U.S. PATENT DOCUMENTS

| | | | |
|---|---|---|---|
| 545,758 | 9/1895 | Aiken | 72/455 |
| 2,722,174 | 11/1955 | Albers | 100/214 |
| 3,418,923 | 12/1968 | Zeitlin et al. | 72/455 |
| 3,479,856 | 11/1969 | Boggio et al. | 72/455 |
| 3,545,372 | 12/1970 | Mueller | 72/455 |
| 3,668,921 | 6/1972 | Budman et al. | 72/455 |

FOREIGN PATENT DOCUMENTS

| | | | |
|---|---|---|---|
| 3432286 | 8/1985 | Fed. Rep. of Germany | 100/214 |
| 1401193 | 4/1965 | France | 100/214 |

*Primary Examiner*—Robert L. Spruill
*Assistant Examiner*—David B. Jones
*Attorney, Agent, or Firm*—Ostrolenk, Faber, Gerb & Soffen

[57] ABSTRACT

A frame for a large 50–500 kiloton forging press including a pair of spaced horizontally crossheads which are interconnected by left and right upright tie-rod assemblies. The crosshead and tie-rod assemblies are connected to one another by way of yoke shaped couplings which are disposed around each end region of the upper and lower crossheads. The tie-rod assemblies which are constructed of a plurality of overlapping elongated plates are pivotally connected to the couplings. The absence of link pins for connecting the tie-rods and crossheads directly to one another improves the distribution of stresses in the frame of the forging press. Apart from the above, plates of the tie-rods are fabricated in sections which are interlinked by suitable link plates to produce sufficiently long tie-rods. The plates of the tie-rods are provided with more than one linking position to the crossheads to allow adjustment of the size of the daylight of the forging press.

13 Claims, 8 Drawing Figures

FORGING PRESS WITH YOKE DESIGN FOR ATTACHING TIE-RODS TO CROSSHEADS

BACKGROUND OF THE INVENTION

This invention relates to presses, in particular to large, up to 500 kiloton, forging presses and is specifically directed to novel tie-rod and tie-rod to crosshead coupling configurations for such presses.

By way of background, a forging press is used for shaping metal ingots or slabs into end products of desired shape. In the press the metal slab is gradually pressed between lower and upper dies in the shape of the final end product. In response to the application of extremely high pressures, on the order of 80,000 psi or more, the metal enters a flowable state which enables it to conform to the shape of the dies.

The larger the size of the end product the greater must be the capacity of the press since the total force developed by the press is distributed over the larger area of the end product. It is apparent therefore that press capacity imposes a limit on the dimensions of forged end products.

The largest presses in the United States today are rated at about 50 kilotons. Thus, conventional presses are inadequate for meeting recent needs for larger forged pieces, particularly for satisfying aircraft industry requirements.

The design of any press entails difficult design considerations because of the sheer enormity of presses of this type. Large forging presses will have a steel frame structure, whose size is equivalent to a building several stories in height. For example, in one particular type of forging press known as a pull-down press the frame is moveable up and down relative to a stationary bridge. An upper crosshead of the frame is used for squeezing the workpiece between the frame and the stationary bridge. The enormous operational stresses which develop in the frame must be distributed evenly, under all circumstances, to prevent overstressing and damage to individual components of the press. Moreover, the estimated cost of several hundreds of millions of dollars of a press of this type is not justified unless the components of the press are designed for a long life of at least ten million press stroke cycles.

Forging press components are described in U.S. Pat. Nos. 3,346,922, 2,756,589 and other patents to which one or more of the inventors of the present application have contributed. A basic forging press frame includes two horizontal upper and lower crosshead assemblies and two or more vertical tie-rod assemblies which connect the upper and lower crosshead assemblies to complete the frame. The overall appearance is that of a window or door frame of enormous size, through which extends the stationary bridge on which the work piece is located. There is clearance under the stationary bridge to permit the upper crosshead of the frame to be lowered onto the stationary bridge or to be raised sufficiently above it to create a space which accommodates the workpiece, its dies, etc.

The present invention is concerned with the structure of the frame for a forging press. The frame is usable with either a pull-down forging press or a stationary forging press. Known frame designs are deemed to be inadequate for larger presses which are now in various planning stages. Known frame designs would present insurmountable fabrication problems in light of available steel industry facilities and would not meet required and desired reliability and design life objectives.

SUMMARY OF THE INVENTION

Accordingly, it is an object of the present invention to provide an improved frame for a forging press.

It is another object of the invention to provide a novel means for interconnecting tie-rod assemblies and crosshead assemblies to one another.

It is still a further object of the invention to provide a forging press frame which can be produced in existing steel fabrication facilities.

It is yet another object of the present invention to provide longer tie-rods to meet requirements for larger up to 500 kiloton presses.

Another object of the present invention is to provide a frame for a forging press which permits adjustment of the daylight of press.

The foregoing and other objects of the present invention are realized with a frame which includes an upper crosshead which will extend above and generally transversely across a stationary bridge. The upper crosshead projects above a platen on the bridge on which a workpiece will be located. A lower crosshead extends below the bridge generally coextensively with the upper crosshead and the two are interconnected by means of first and second vertically extending tie-rod assemblies on opposite sides of the bridge to form a frame through which the bridge passes.

The manner in which the upper crosshead of the frame is lowered onto the bridge and pressed with great force thereagainst is described later herein. Of importance is the novel yoke shaped coupling structure which is located at each end of a tie-rod assembly. The coupling is connected to an end of the tie-rod assembly and fits over a respective end region of the upper or lower crossheads to complete the frame.

Various yoke shaped coupling embodiments are provided. Generally, a crosshead assembly, whether an upper crosshead or a lower crosshead, includes a plurality of distinct sections, each of which is constructed as an array of superposed and interconnected long plates. A first coupling embodiment includes a thick layer of upright plates which extends generally transversely to the direction of the cross head plates and over all the sections of the crossheads. A similar layer of plates is located below the crosshead. The upper and lower coupling plates are interconnected by a plurality of upright legs which extend between the sections of the crosshead assembly and on the outside thereof. Each upright leg is again comprised of an array of superposed generally elongated rectangular plates. The tie-rod assemblies, also constructed of long elongated and superposed plates, are pivotally connected to the coupling structure by suitable link pins.

A second embodiment is similar to the first embodiment except that each section of crosshead assembly is received within its own yoke shaped coupling section. This differs from the first embodiment wherein a single yoke shaped coupling encloses all the sections of the crosshead.

A third embodiment is similar to the second embodiment in that each section of crosshead plates has its own coupling section. However, in this embodiment only one assembly of transversely extending yoke plates are provided. They are located outside the crossheads, namely on top of the upper crossheads and below the lower crossheads. The tie-rods are connected directly to these outside plates by passing between the crosshead sections and on the sides thereof.

An upper platen extends directly below the upper crosshead and another platen is located on top of the lower crosshead. The upper crosshead plates are sandwiched between the upper platen and the upright plates of the yoke shaped coupling. In the third embodiment the tie-rod plates are longer to bridge a distance of about one hundred and fifty feet between the upper and lower crossheads. To simplify fabrication and handling, each tie-rod plate consists of two approximately equal sections which are joined to each other by suitable link plates.

In a fourth embodiment of a frame for a forging press, a yoke shaped coupling is not employed. The tie-rods and the crosshead assemblies consists of superposed plates, the ends of which are interleaved with one another and linked by suitable link pins which penetrate through the plates of the tie-rods and crossheads. This is a conventional design. But to enable fabrication of longer tie-rod plates particularly for the very large forging presses, each tie-rod plate consists of first and second sections which are joined to each other by suitable link plates to achieve an overall required length.

The above embodiment is particularly suitable for realizing a forging press which can provide more than one daylight. "Daylight" refers to the maximum opening between the upper crosshead and the bridge on which an object to be pressed is located. A larger daylight is required for accommodating larger forging tools such as dies or the like. However, during production runs of smaller pieces, it is disadvantageous to have a larger daylight. Accordingly, those plate sections of the tie-rods which are connected to the lower crossheads can be provided with an extra set of connection points, usually pin holes for link pins to permit shortening of the distance between the upper and lower crossheads. Then, when a smaller daylight is required the lower crosshead is connected to the tie-rods at a higher point. This will reduce the distance between the upper crosshead and the lower crosshead to produce a reduced size daylight.

Other features, advantages and uses of the present invention will become apparent from the following description of preferred embodiments which are described in conjunction with the appended drawings.

DETAILED DESCRIPTION OF THE INVENTION

Figure 1:
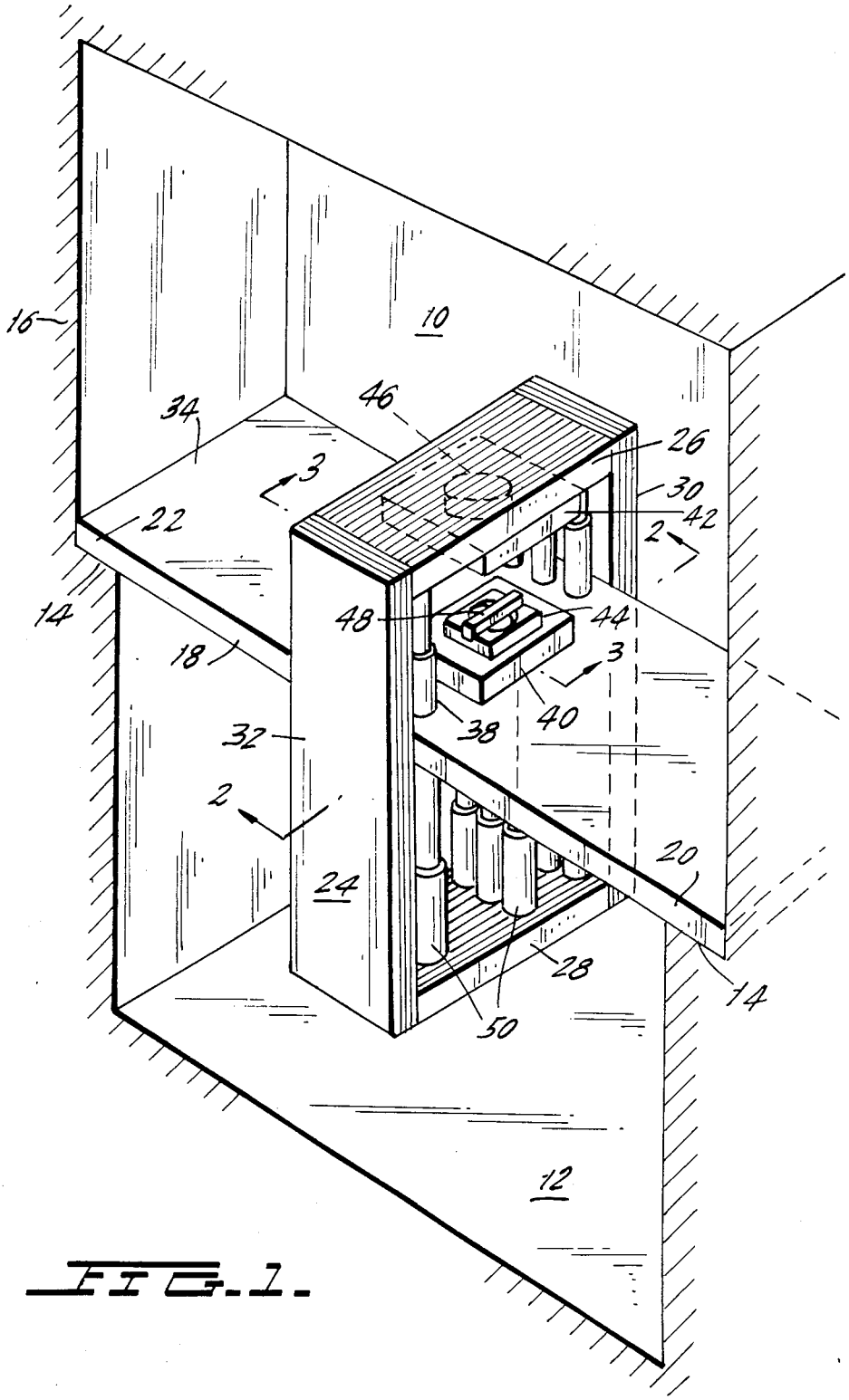
FIG. 1 is a perspective of a schematically illustrated pull-down forging press.
Figure 2:
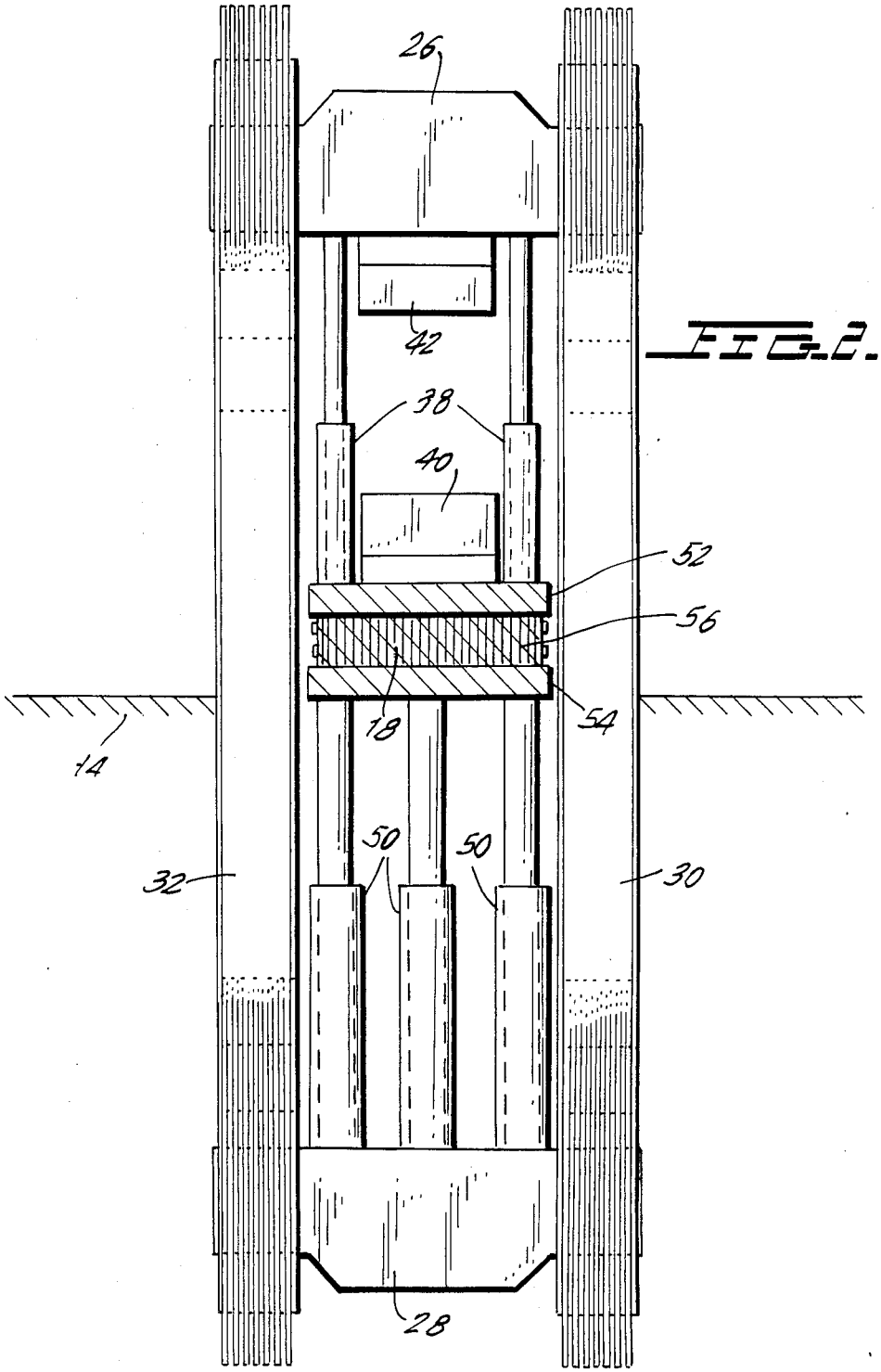
FIG. 2 is a section through FIG. 1 along line 2—2.
Figure 3:
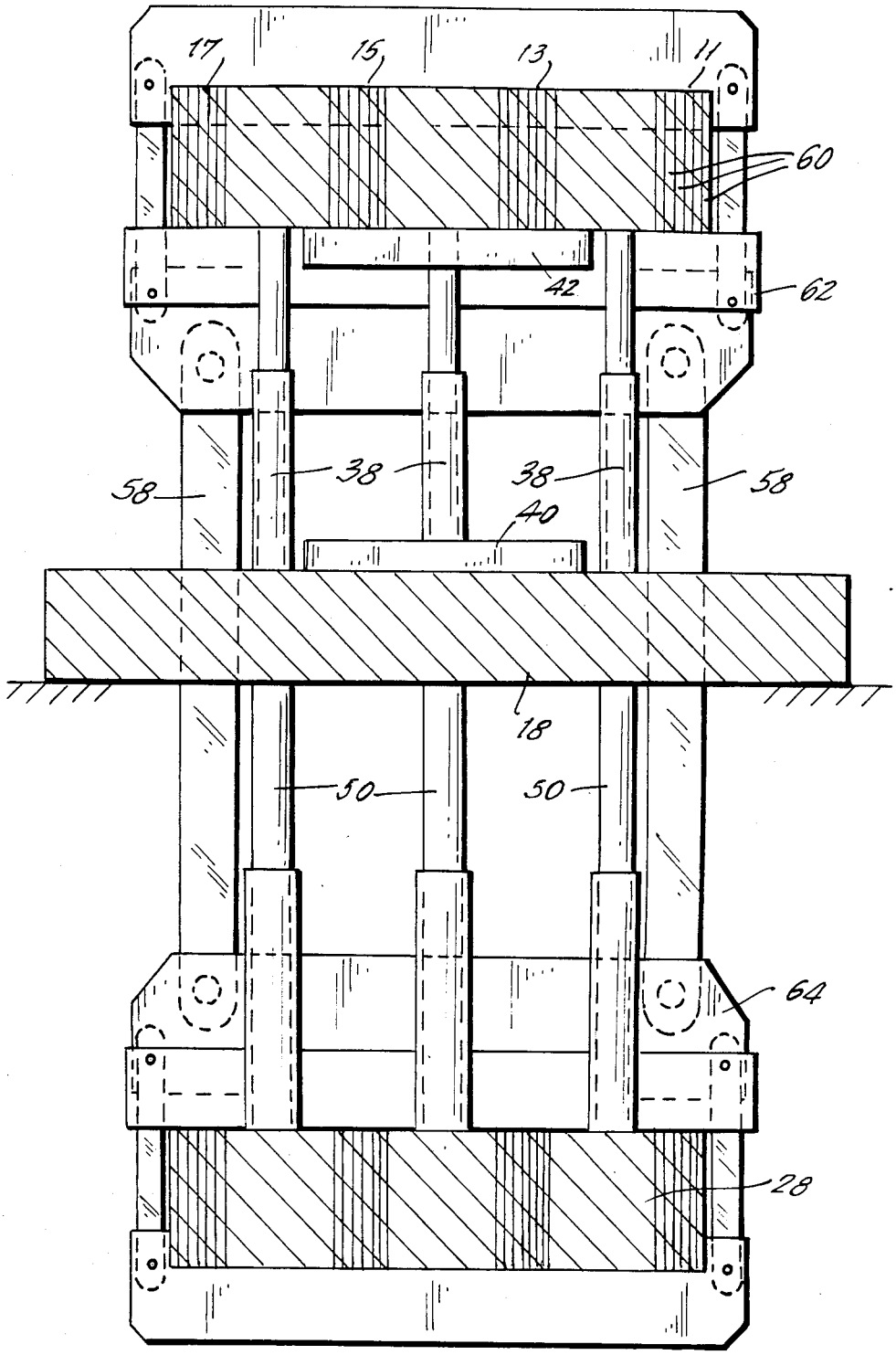
FIG. 3 is a section through FIG. 1 along line 3—3.

FIGS. 1–3 illustrate schematically major components of a pull-down forging press. It should be noted right at the outset that FIGS. 1–3 are only schematic drawings which are presented for describing certain forging press concepts and the general environment of the present invention. FIGS. 1–3 are not intended to accurately represent any known forging press. They are not consistent with one another nor with actual embodiments of the present invention to be described herein.

Referring first to FIG. 1, a forging press 10 there illustrated is housed in a building structure for a forging press having a foundation pit 12 below ground level 14 and a main building 16 above ground level. A bridge 18 extends across the foundation pit 12 and is supported at its ends 20 and 22 by the building structure at about ground level.

A frame 24 surrounds bridge 18 and includes an upper crosshead assembly 26 above the bridge, a lower crosshead assembly 28 located below the bridge and first and second tie-rod assemblies 30 and 32, for connecting the upper and lower crossheads 26 and 28 to one another to complete the frame structure. The frame 24 is moveable up and down in a manner which permits the upper crosshead 26 to be raised and lowered with respect to the top 34 of the bridge 18.

A plurality of return cylinders 38 extend between the top 34 of the bridge 18 and the upper crosshead assembly 26 for supporting the upper crosshead assembly 26 above a work piece platen 40 which is located on the bridge 18. An upper platen 42 is secured to the upper crosshead assembly 26 and projects above workpiece platen 40. The workpiece and upper platens 40 and 42 are secured respectively and an upward facing bottom die 44 and a down facing top die 46. A metal ingot or slab 48 is located between dies 44 and 46 to be compressed therebetween to form an end product having a desired shape and characteristics.

To form the ingot or slab 48 into an end product the pressure in return cylinders 38 is relaxed to bring the upper die 46 to bear against the ingot 48 upon lowering of frame 24. To provide the necessary forging forces, a plurality of main cylinders 50 located below the bridge 18 and extending between the lower crosshead assembly 28 and the bottom of the bridge 18 are actuated to pull the frame down with great force thereby squeezing and forging the metal ingot between dies 44 and 46.

There are more main cylinders 50 than there are return cylinders 38 and each of the main cylinders is larger in size and capacity since the forging forces are far greater than the forces required to merely raise or lower frame 24.

FIG. 2 is an illustration of a more realistic press design which is depicted as it would appear if viewed from line 2—2 in FIG. 1. Ground level 14 is shown to coincide with the position of bridge 18 which will typically be constructed of an upper steel structure 52, a lower steel structure 54 and an array of steel plates 56, located therebetween to provide a bridge of sufficient load handling capability. Return cylinders 38 as well as the upper and lower platens 42 and 40 are located above the bridge 18. The main cylinders 50 extend below bridge 18 and lower crosshead assembly 28.

Each of the crosshead assemblies 26 and 28 as well as the tie-rod assemblies 30 and 32 is constructed as a lamination or an array of overlapping beam plates each of which is essentially in the shape of a long, flat rod.

In FIG. 2 is shown the shape of a single rod or plate of the crosshead assembly 26 or 28 as well as a plurality of rods which form each tie-rod assembly 30 or 32. On the other hand, the shape of tie-rod assembly plates 58 may be seen in FIG. 3 which look in the direction of line 3—3 in FIG. 1. FIG. 3 reveals that each one of crosshead assemblies 26 and 28 is formed of several sections 11, 13, 15 and 17, each of which is constructed of a plurality of superposed rectangular rods 60.

As seen in FIG. 3, tie-rod bars 58 are not connected directly to crosshead assemblies 26 and 28. Rather, the tie-rod bars are connected to yoke shaped coupling structures, for example, upper coupling 62 which embraces an end region of upper crosshead assembly 26.

Figure 6:
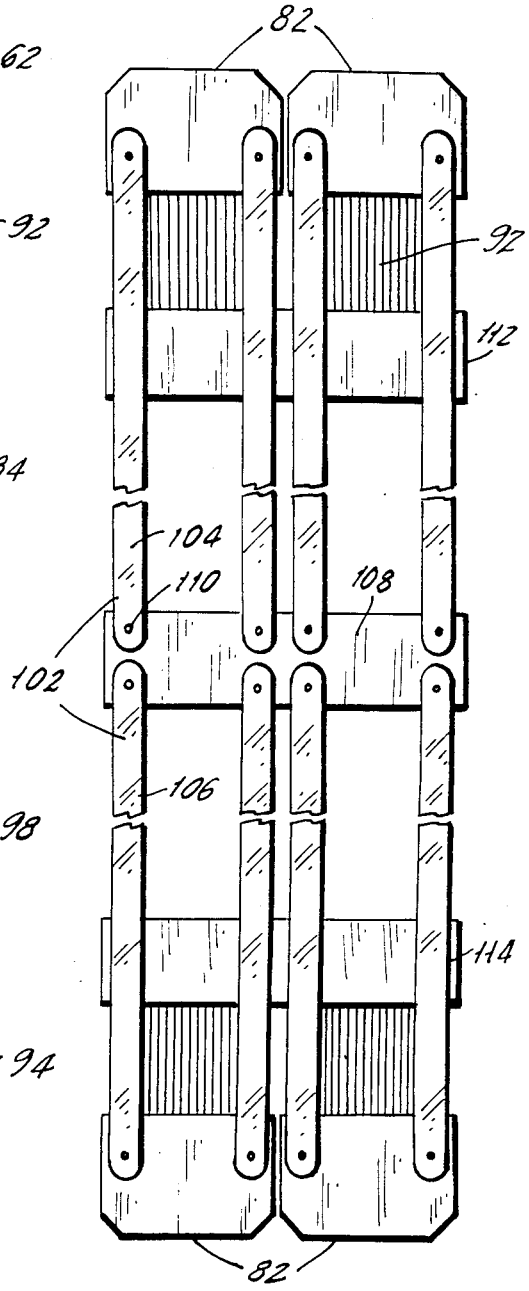
FIG. 6 is a second embodiment for a yoke shaped coupling.
Figure 7:
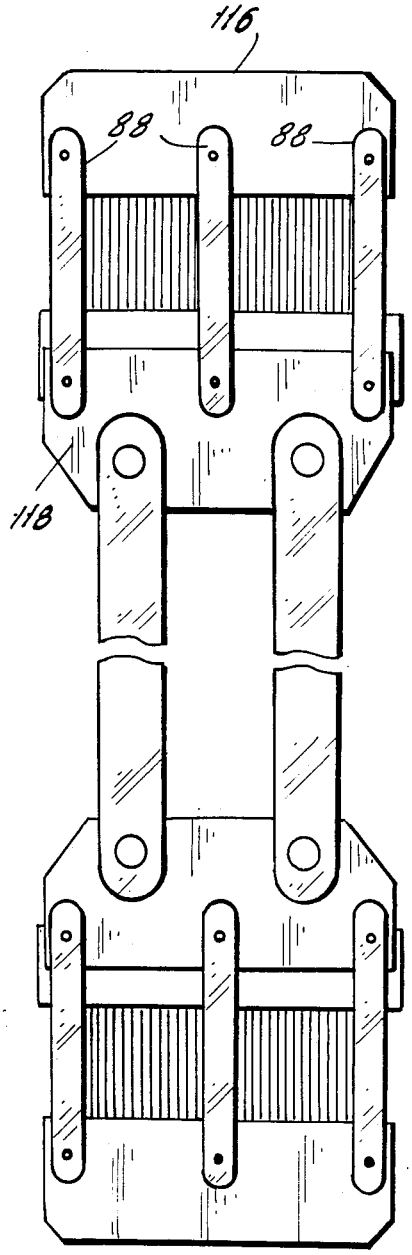
FIG. 7 is a third yoke shaped coupling embodiment.
Figure 8:
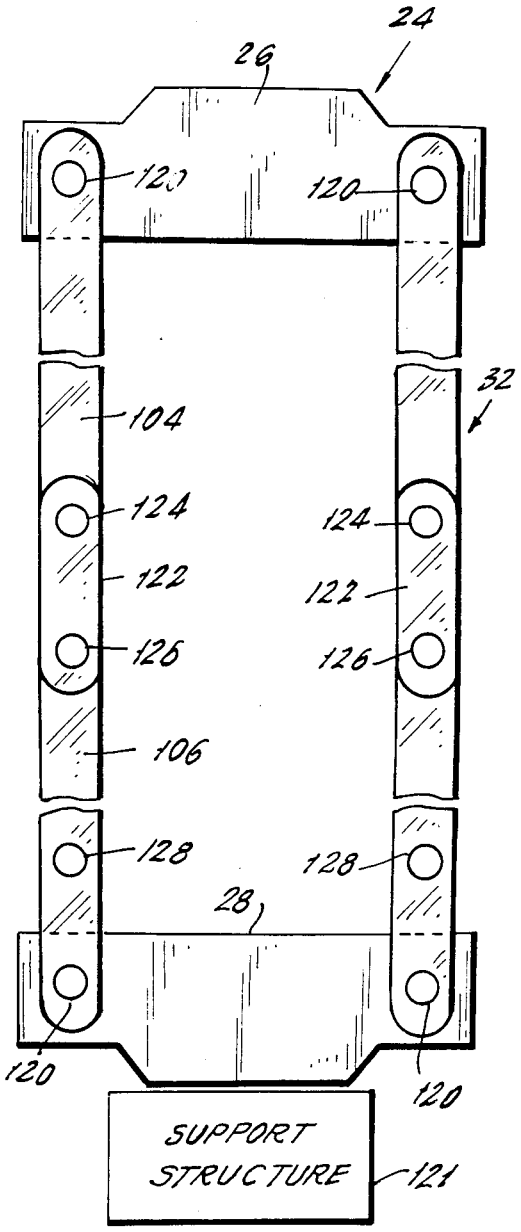
FIG. 8 is an illustration of tie-rod plates comprised of first and second sections joined to each other by link plates. Also shown are intermediate holes in the tie-rod plates for controlling daylight of the forging press.

This invention focuses on three yoke-shaped embodiments which are illustrated in FIGS. 4–7 and to an adjustable daylight embodiment which is shown in FIG. 8.

Figure 4:
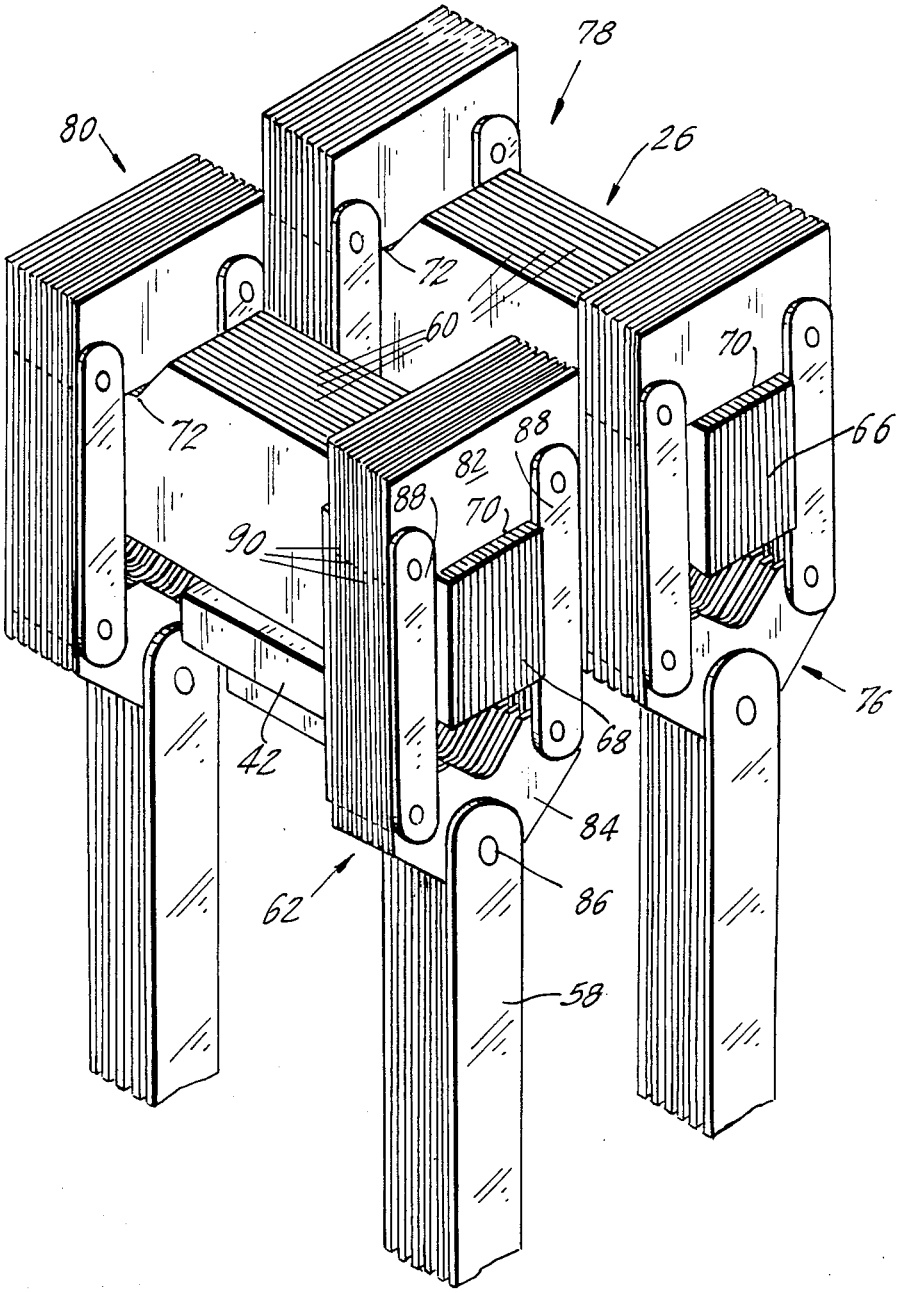
FIG. 4 is a perspective of one embodiment of a yoke shaped coupling which fits over an end region of a crosshead section to which tie-rod plates are connected.

Referring to FIG. 4, upper crosshead assembly 26 is shown to include a first crosshead section 66 and a spaced second crosshead section 68. The platen 42 extends below the sections of the crosshead and generally transversely to plates 60 of the crosshead. Each crosshead section 66 or 68 has a first cut out end region 70 and a second cut out end region 72 of reduced size for accommodating a respective coupling such as coupling 62 thereon. Coupling 62, and similarly each of the other couplings 76, 78 and 80, includes a top member 82 and a bottom member 84 to which bars 58 of the tie-rod assemblies are connected by means of link pins 86 to permit pivoting therebetween. Link or leg plates 88 flank the end region of the crosshead and connect the top member 82 and the bottom member 84 to complete a yoke shaped coupling as shown. In a manner similar to the construction of the other structural members of the frame, various components of coupling 62, are also formed by superposed rods 90.

Figure 5:
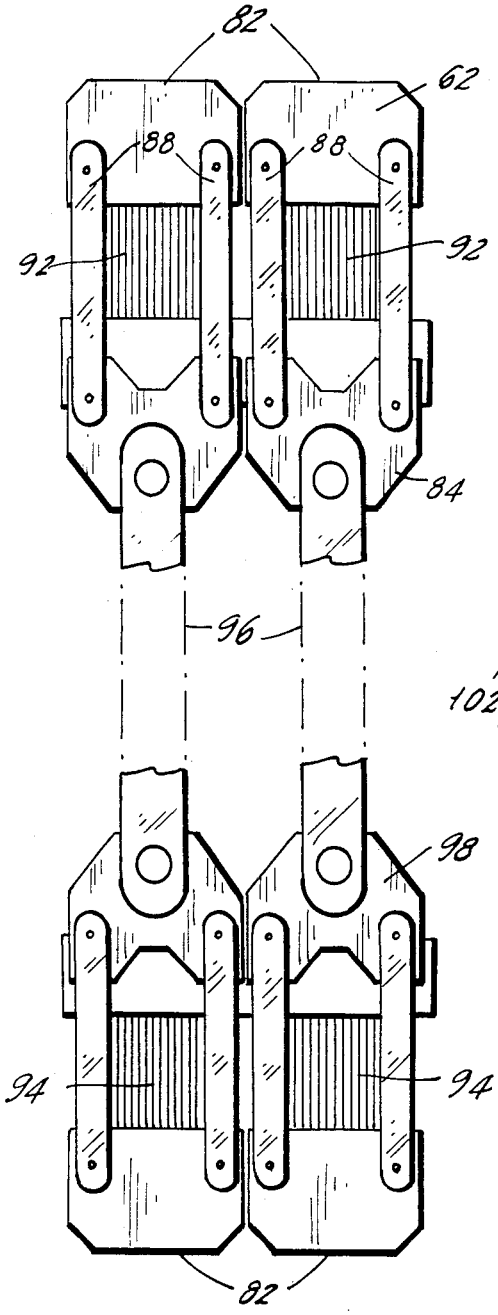
FIG. 5 is a first embodiment of a yoke shaped coupling.

FIGS. 5, 6 and 7 show three distinct coupling embodiments. Thus, in FIG. 5 note first the crosshead assemblies including upper crosshead 92 and lower crosshead 94 as well as tie-rod assembly 96. The presently described embodiment, shown in perspective in FIG. 4, is distinguished in that there is a distinct coupling section for each section of a crosshead. Thus, each coupling section, for example, coupling 62 includes top member 82, a sling shaped bottom member 84 and linking legs 88 therebetween. Note that the couplings 98 for the lower crosshead assembly 94 are oriented upside down with top member 82 being on the bottom.

In the second yoke frame embodiment illustrated in FIG. 6 top members 82 are identical to those found in the embodiment of FIG. 5. The configuration of the tie-rod assembly 100 is, however, unique. Thus, each one of tie-rod plates 102 are connected directly to top members 82. Bottom members as in the previous embodiment are not provided. To overcome the difficulties of fabricating longer tie-rod plates required for this embodiment, each tie-rod plate is comprised of an upper tie-rod section 104 and an lower tie-rod section 106 as shown. A tie-rod plate linking member 108, formed of a layer of superposed plates which are interleaved with the tie-rod plates to effect an interconnection therebetween by means of pins or rivets 110 as shown. Note that the linking member 108 extends transversely to the tie-rods so that a single linking member interconnects all the tie-rod bars of a given tie-rod assembly.

An upper support 112 and a similar lower support 114 are disposed, respectively, below and above upper and lower crosshead assemblies. Return cylinders (not shown in this Fig.) will support upper support 112 against the upper crosshead 92.

A third coupling embodiment is illustrated in FIG. 7. This embodiment should be compared to the embodiment of FIG. 5 to note that the difference between them is that rather than having an individual coupling section for each section of a given crosshead assembly, a single top member 116 and a single bottom member 118 extend transversely across all the sections of the crosshead assembly. Linking plates 88 extend on the outside and between the crosshead sections to connect top member 116 and bottom member 118 to each other.

FIG. 8 illustrates a frame 24 wherein the crosshead and tie-rods coupling is effected by means of linking pins 120 without coupling structures as described in the foregoing embodiments. Since a frame of this type for a 200 kiloton forging press requires tie-rod plates of considerable length, each tie-rod plate 96 is formed of an upper plate section 104 and a lower plate section 106, in a manner similar to the embodiment of FIG. 6. The plate sections are linked to each other by suitable connection plates 122 which are interleaved between the plates of the tie-rod to effect a connection by means of pins 124 and 126.

The plate sections 106 which connect to the lower crosshead assembly 28 are provided with extra pin holes 128 which are nearer to lower crosshead assembly 28. The lower crosshead assembly 28 may be connected to the tie-rod assembly 32 at the holes 128. By bringing the upper and lower crosshead assemblies closer to one another the forging press will have two distinct daylight settings. It is unknown to provide such a feature in forging presses of this type. The reduced daylight provided by means of holes 128 offers distinct operational advantages during production runs wherein smaller sized products are being fabricated.

To change the daylight spacing one very simply locates a support structure 121 (FIG. 8) under lower crosshead assembly 28, operates return cylinders 38 (FIGS. 1, 2, 3) to relieve the pressure.

Although, the present invention was described in connection with a plurality of preferred embodiments thereof, many other variations, modifications and other users will now become apparent to those skilled in the art. It is therefore preferred that the present invention be limited not by the specific embodiments disclosed herein but only by the appended claims.

What is claimed is:

1. A frame for a 50–500 kiloton forging press, comprising:

a load opposing upper and generally horizontally extending crosshead assembly having first and second end regions at opposite longitudinal ends thereof;

a load opposing lower crosshead assembly having its respective first and second end regions, said lower crosshead assembly being spaced from, parallel to, and generally coextensive with said upper crosshead assembly;

a respective yoke shaped coupling disposed at each one of said end regions of said upper and lower crosshead assemblies, each said respective yoke shaped coupling including a top member, a bottom member and link plates, said top and bottom members and link plates being interconnected to form a coupling enclosure which fits around the end region; and first and second tie-rod assemblies for completing said forging press frame, said first tie-rod assembly extending generally in a vertical direction from said first end region of said upper crosshead assembly to said first end region of said lower crosshead assembly, said second tie-rod assembly extending between said second end regions of said crosshead assemblies, each of said tie-rod assemblies having respective first and second longitudinal ends and each said longitudinal end being pivotably connected to a respective one of said bottom members of said yoke coupling which is disposed adjacent thereto.

2. The frame of claim 1, in which said frame includes a bridge extending through said frame and wherein said frame is moveable up and down to compress an object.

3. The frame of claim 1, wherein said frame remains stationary and said bridge is movable in relation thereto.

4. The frame of claim 1 in which said respective yoke shaped coupling comprises a frame which fits around a respective one of said end regions of one of said crosshead assemblies and further comprising pin link means for connecting the yoke shaped coupling to a given one of the tie-rod assemblies.

5. The frame of claim 4 wherein each crosshead assembly is comprised of a plurality of crosshead sections which sections are horizontally spaced from and coextensive with each other, said yoke shaped coupling comprising an outside facing top member which includes a plurality of upright and overlapping plates extending transversely across the top of the upper crosshead assembly and the bottom of the lower crosshead assembly, a plurality of depending legs connected to the top member, said legs extending between the crosshead sections and on the outside thereof toward the tie-rod assemblies, and a bottom member which is generally coextensive with the top member of the yoke shaped coupling and which is connected to the legs, said pin link means being located in the bottom member to pivotally connect the bottom member to an end of a respective one of the tie-rod assemblies.

6. The frame of claim 5 in which each of said tie-rod assemblies includes respectively at least two columns of tie-rod arrays, each array comprising a plurality of overlapping beam plates, a respective pin in each end of each tie-rod column connecting said column to said bottom member of said yoke shaped coupling.

7. The frame of claim 5 in which each crosshead assembly is comprised of a plurality of crosshead sections which sections are horizontally spaced from and coextensive with each other, said yoke shaped coupling comprising a respective top yoke member for each crosshead section, said top yoke member including a plurality of upright and overlapping plates extending transversely across the outside surface of its crosshead assembly section, the tie-rod assemblies comprising respective first and second tie-rod columns for each crosshead section, the tie-rod columns of a given crosshead section being connected directly to said top yoke member of the upper and lower crosshead assemblies.

8. The frame of claim 7 wherein each column of tie-rods is comprised of an array of overlapping beams which beams are interleaved with the upright plates of the top yoke member.

9. The frame of claim 8 wherein the overlapped beams of each column of tie-rods is comprised of first and second beam sections and link plate means for connecting one beam section to its adjoining section whereby longer tie-rod beams are obtained.

10. The frame of claim 9 in which said link plates means extend transversely to the direction of the tie-rod beams and wherein said plates extend across all the columns associated with one of said tie-rod assemblies, and further comprising an upper support and a lower support located respectively below the upper crosshead assembly and above the lower crosshead assembly and means for retaining the upper support against the upper crosshead assembly.

11. The frame of claim 4 in which each crosshead assembly is comprised of a plurality of crosshead sections which sections are horizontally spaced from the coextensive with each other, said yoke shaped structure comprising a respective yoke shaped section for each of said end regions of said upper and lower crosshead assemblies, each yoke shaped section including a plurality of upright top plates disposed generally transversely to the crosshead, a plurality of bottom upright cross plates extending generally in the same direction as the upright top plates of the yoke shaped section and spaced therefrom, and a plurality of linking plates which flank the crosshead sections to join the top and bottom plates of the yoke shaped section to one another, the bottom upright plates including link pin means for connection thereof to a respective one of said tie-rod assemblies, given ones of said yoke shaped sections which are associated with said lower crosshead assembly being disposed in an upside down orientation.

12. The frame of claim 11 wherein said bottom upright cross plates are generally sling shaped and wherein each yoke shaped section is fitted over one of said end regions of one of said crosshead sections such that said sling shaped bottom upright cross plates faces toward the tie-rod assembly for both the upper and lower crosshead assemblies.

13. The frame of claim 12 wherein the linking plates are welded to the top and bottom plates.

* * * * *